United States Patent [19]

Schleffendorf

[11] 4,290,597

[45] Sep. 22, 1981

[54] PHYSICAL EXERCISE APPARATUS

[76] Inventor: John J. Schleffendorf, 2312 Crescent Ave., Waukegan, Ill. 60085

[21] Appl. No.: 129,115

[22] Filed: Mar. 10, 1980

[51] Int. Cl.[3] ..... A63B 21/08

[52] U.S. Cl. ..... 272/117

[58] Field of Search ..... 272/85, 88, 90, 91, 272/61, 93, 109, 116 R, 116 A, 117, 118, 134, 143, 144, DIG. 2, DIG. 4, 24, 136, 900

[56] References Cited

U.S. PATENT DOCUMENTS

| | | | |
|---|---|---|---|
| 448,305 | 3/1891 | Thayer | 272/136 X |
| 726,095 | 4/1903 | Nightingale | 272/136 |
| 1,974,531 | 9/1934 | Dahl | 272/61 |
| 2,855,199 | 10/1958 | Noland et al. | 272/117 |
| 3,019,019 | 1/1962 | Forte | 272/117 |
| 3,115,339 | 12/1963 | Forte | 272/117 |
| 3,189,347 | 6/1965 | Dodge | 272/117 |
| 3,364,747 | 1/1968 | Ebstein | 272/117 X |
| 3,558,130 | 1/1971 | Anderson | 272/117 X |
| 3,708,167 | 1/1973 | Potgieter | 272/117 |
| 3,850,430 | 11/1974 | Hamilton | 272/117 |
| 3,966,203 | 6/1976 | Bickford | 272/118 |
| 4,084,815 | 4/1978 | Flannery | 272/117 X |
| 4,243,219 | 1/1981 | Price | 272/117 |

FOREIGN PATENT DOCUMENTS

| | | | |
|---|---|---|---|
| 425012 | 2/1926 | Fed. Rep. of Germany | 272/116 A |

*Primary Examiner*—Richard J. Apley

*Attorney, Agent, or Firm*—Hill, Van Santen, Steadman, Chiara & Simpson

[57] ABSTRACT

A physical exercise apparatus for performing a wide range of exercises for the development of wide range of human skeletal muscles includes a weight means that is suspended by a line from a fixed support, and a tug line extends laterally therefrom to end portions that are gripped by the subject performing the exercises. The weight means in its gravity neutral position has a stop, and is uniquely suspended when out of that position so that the mass is stable and so that removable weights forming a part of such mass will not fall off due to inertia of motion. The support line is adjustable in effective length to adapt the apparatus to various sizes of subject and to various exercises and likewise to alter the resistance curve produced by this apparatus. Lateral force applied to the tug line in a direction away from the apparatus, produces an ever increasing isotonic resistance which gradually merges into a quasi-isometric condition at the limit of the capability of muscular contraction.

13 Claims, 10 Drawing Figures

PHYSICAL EXERCISE APPARATUS

BACKGROUND OF THE INVENTION

1. Field of the Invention

This invention relates to physical exercise apparatus for use in developing human muscles.

2. Prior Art

The human body has a substantial number of muscle groups and in the past various types of mechanical exercise equipment have been used to increase both muscular strength and size. However, many prior exercise devices have been either relatively complex, expensive, or limited in versatility and efficiency in terms of the number of muscle groups an individual apparatus could adequately develop.

Prior devices have often utilized cams, pulleys, levers or frictional mechanisms to provide a resistance force against which muscular training could be accomplished. But all such devices have been inadequate in providing a resistance curve most suitable for rapid and efficient muscular development.

Physiological studies have shown that in most cases power output (strength) exerted by the human limbs or trunk, actually increases as these limbs or trunk approach positions of full extension or flexion, due to the unique interactions of muscular strength curves and skeletal leverage, and that maximal contraction of muscle fiber occurs when a muscle is sustained in a static, or isometric, contractile state.

Therefore, throughout the range of an exercise movement, resistance should, in most cases, actually steadily increase against the contracting muscle(s), and a static, or isometric, contraction should be experienced within the terminal range of the movement.

Designers of prior exercise equipment have failed to recognize this principle and have provided resistance curves, inadequate in terms of generating maximum contraction of muscle fiber at the position of greatest musculoskeletal strength advantage.

Even most elaborate training devices, using expensive systems of cams and gears, and which provide a variable resistance to approximately match a muscles' strength curve, fail to provide the necessary static, or isometric, resistance within the range of greatest musculoskeletal strength advantage.

Other types of apparatus, namely gravitationally influenced barbells and dumbells, produce a resistance that may actually decrease as the exercised bodypart approaches its position of greatest strength output.

With some apparatus, such as fixed pulley/cable systems, a constant resistance is at least provided, but an unwanted mechanical advantage may be introduced due to an incorrect angle of pulling or tugging, namely that the moment arm has changed incorrectly.

SUMMARY OF THE INVENTION

Physical exercise apparatus according to the invention includes a weight means secured to the lower end of a support line, the upper end of which support line is secured to a fixed support bracket. At least one tug line is secured to the weight means and extends laterally therefrom and has means at its other end by which a lateral tugging force may be applied thereto. The point of support of the support line or its length may be altered to compensate for the size of the subject and the exercise to be performed and also to alter the resistance curve produced by this apparatus. A stop is provided to limit return movement of the weight means, and a restraining line is secured to the weight means to add additional resistance to it in proportion to the rate at which the weight means is moved away from vertical. In a preferred embodiment, the weight means is a cage which has an upstanding post receptive of barbell weights, the cage being so supported and tugged on that the center of gravity of weight means is always below both lines, the cage being so tilted and held that individual weights in the cage cannot fall off while the weight means maintains a stable attitude during movement.

Ten different exercises are defined for use with the apparatus, and each exercise develops one or more of ten identified muscle groups.

Accordingly, it is an object of the present invention to provide a rather versatile physical exercise apparatus.

Another object of the present invention is to provide a physical exercise apparatus which is correct in terms of resistance curve and moment arm alignment, that is, to provide a constantly increasing isotonic resistance which, by the end of an exercise movement changes to a quasi-isometric resistance force, and at all times maintaining an approximately proper moment or orientation.

Another object of the present invention is to provide an exercise apparatus which avoids the problems enumerated above as well as to provide a mechanism which is virtually free from unwanted frictional influences.

Many other advantages features and additional objects of the present invention will become manifest to those versed in the art upon making reference to the detailed description and the accompanying sheets of drawings in which a preferred structural embodiment incorporating the principles of the present invention is shown by way of illustrative example.

ON THE DRAWINGS

FIGS. 6–10 schematically represent substantially the ultimate position of the body for each of five representative exercises.

AS SHOWN ON THE DRAWINGS

Figure 1:
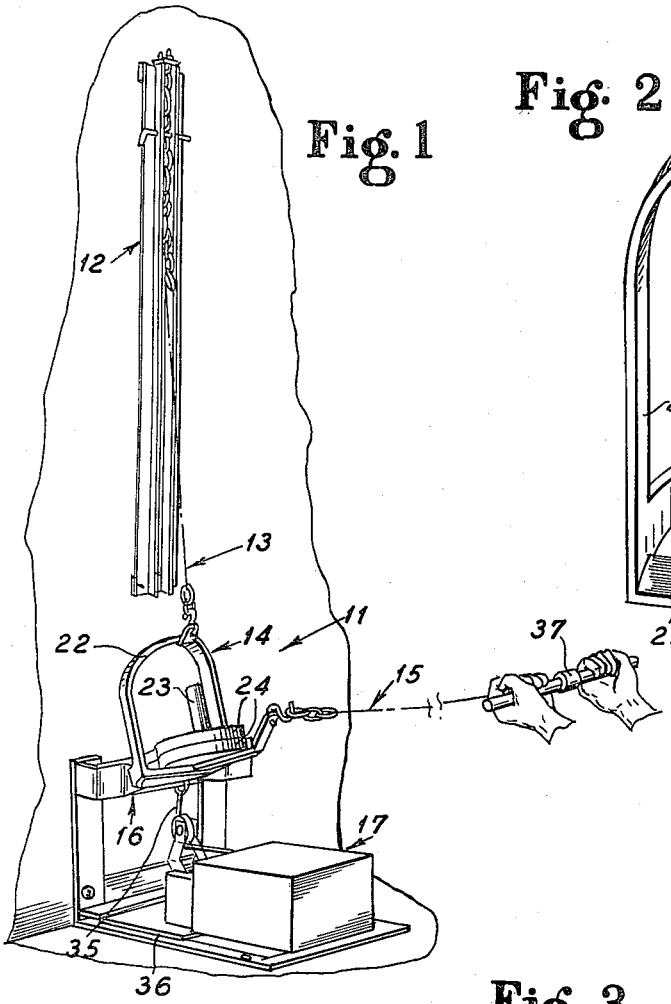
FIG. 1 is a perspective view of a physical exercise apparatus provided in accordance with the present invention.
Figure 4:
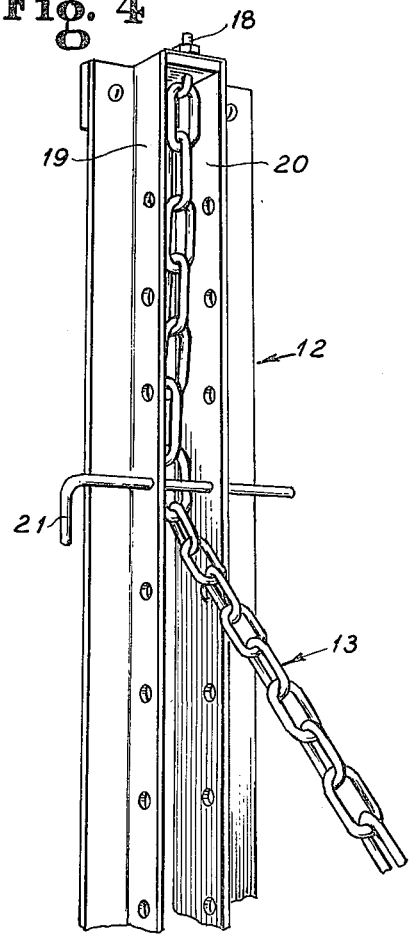
FIG. 4 is an enlarged fragmentary view in perspective from below of the upper portion of FIG. 1.

A physical apparatus according to the invention is shown in FIG. 1, generally indicated by the numeral 11. The apparatus 11 includes a support bracket 12, a support line 13 in the form of a chain, weight means 14 secured to the lower end of the support line 13, and at least one tug line 15 in the form of a chain, cable or combination thereof, secured at one end to the weight means 14 and having means at the other end by which the body may apply a lateral tugging force. The apparatus 11 further includes a stop 16 and a restraining means 17. As best shown in FIGS. 1 and 4, the support bracket 12 is adapted to be fixedly secured in place, here against a vertical wall at a selected height. The support bracket 12 has means acting between it and the support line 13 for varying the effective length of the support line 13 and the effective height of its upper end by which it is anchored, as by a U-bolt 18 to the upper end of the bracket 12. In this embodiment, the support bracket 12 has a pair of spaced vertical flanges 19,20 and each of these has a vertical row of apertures, each aperture in one flange 19 being in alignment with the aperture in the other flange 20. The support line 13 is disposed between the flanges 19,20, such as rearwardly of the apertures, and a pin 21 is receivable in a selected pair of aligned apertures, and when in such position, as shown, the pin 21 traps an upper end portion of the support line 13, thereby effectively lowering its point of support and also shortening the effective length thereof.

Figure 2:
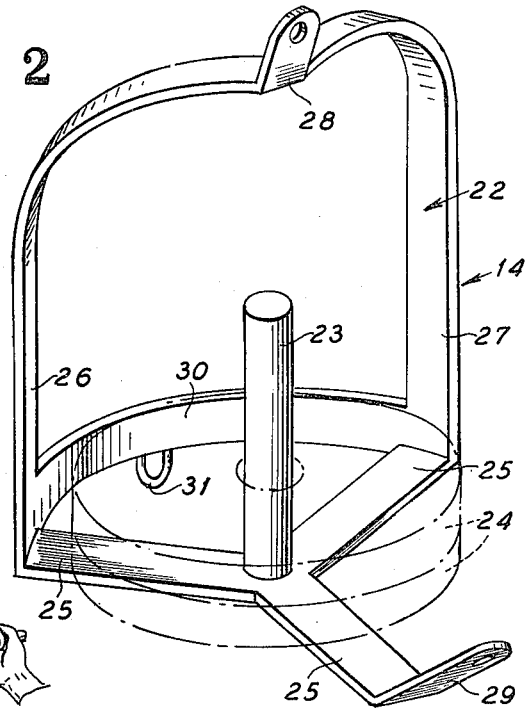
FIG. 2 is an enlarged perspective view of a cage forming a part of the weight means shown in FIG. 1.

As best shown in FIG. 2, the weight means 14 is here formed as a cage 22 which has means for supporting a selected number of weights therein. The weight supporting means in this embodiment comprises a generally upstanding post 23 which preferably has a diameter of 1⅛ inch so as to be capable of cooperating with standard commercially available barbell weights 24,24. For example, each of these may have a weight of twenty-five pounds and there is room for six such weights within the cage 22 on the post 23. The cage 22 includes a Y-shaped base 25 having three legs with a pair of risers 26,27 extending upwardly from the extreme ends of the legs 25 and curving radially inward to a point just above the mounting post 23, and being joined together. At such junction, there is a tab 28 which extends above the third base leg 25 at an angle of about 45 degrees. At the outer end of the third base leg 25, there is a further tab 29 that also extends upwardly at an angle of about 45 degrees. Both the upper and lower tabs 28,29 extend beyond the center of gravity of the weight means, the support line 13 being secured to the upper tab 28 and the tug line 15 being secured to the lower tab 29. With this arrangement, the center of gravity of the weight means will always be below the lines 13,15 for every position thereof during use. Further with this arrangement, several advantages are obtained. The cage 22 can have weights 24 loaded and unloaded without anything being disconnected. Not only does the presence of the tabs 28,29 keep the center of gravity below both lines, but their 45 degree angles keep the weights or load tilted so that the weights cannot fall off during movement thereof. The inertia of motion that becomes imparted to the weights during movement will thus not be sufficient to cause the weights to move of their own inertia and thus they cannot fall off. Further, this support arrangement serves to dampen any swaying in a front to rear direction because the arrangement has an antipendulous action, and also the construction eliminates any tendency for the weight mass to swing rotationally, namely to move in a left to right direction. The mounting post 23 cradles and supports the weights that are used.

The cage 22 has an arcuate portion 30 that extends between the lower ends of the risers 26,27, and the outer convex surface thereof serves as a bumper for engaging the stop 16. The arcuate portion 30 also has a lug 31 to which the restraining means 17 is connected.

Figure 3:
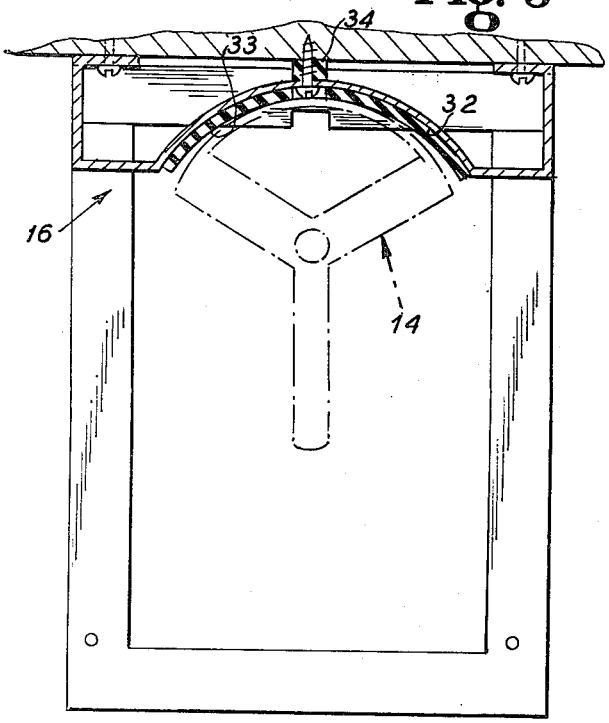
FIG. 3 is an enlarged top view, partly broken away, of a portion of FIG. 1.

As shown in FIG. 3, the stop 16 is also adapted to be fixedly secured in place, such as against the wall to which the support bracket 12 is secured, and the stop 16 is disposed to be engaged by the weight means 14 when no tugging force is applied to the tug line 15. The stop 16 is made of sheet metal that has some resiliency, there being an arcuate nest 32 which is lined with an elastomer 33 against which the bumper portion 30 of the cage 22 comes to rest. A further piece of elastomer 34 is disposed between the metal that defines the nest 32 and the adjacent wall for damping inward movement of the stop at its center. An optional feature of the disclosed device is the restraining means 17 which includes a restraining line 35 connected at one end to the lug 31 of the weight means 14, the line 35 having a portion wound onto to a governor-controlled reel (not shown) whereby additional resistance is added to the weight means 14 in direct proportion to the rate of pull on the tug line 15. The restraining means 17 adds to the system an isokinetic resistance source. It is a governor-controlled frictional braking device—a speed regulated resistance source, an example of which is manufactured and sold by Mini Gym Inc., Independence, Mo.; as its details do not form a part of my invention, further disclosure as to the details is not necessary. When used, it is anchored to the floor by being secured to a frame 36, also associated with the stop 16.

There is at least one tug line 15 and in some instances, it is desirable to add a second tug line 15. Each tug line 15 has tugging means on the other end thereof. As shown in FIG. 1, the tugging means is a centrally connected bar 37 adapted to be gripped by two hands. As shown diagramatically in each of FIGS. 8 and 9, the tugging means may comprise a looped strap or harness 38 through which the head of the subject may extend. As shown in each of FIGS. 7 and 10, two of said tug lines 15 may be used in which case the tugging means comprises separate hand grips 39,39 connected to the other or free ends of the tug lines 15,15 respectively.

Figure 5:
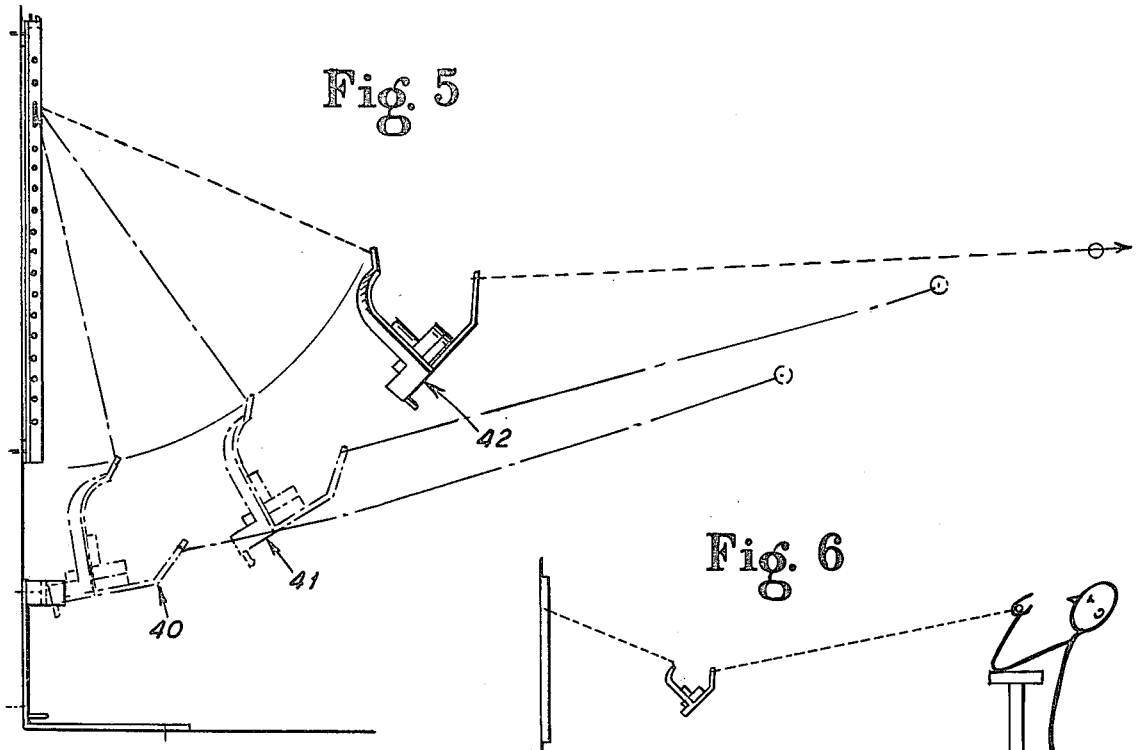
FIG. 5 illustrates the operation of the device.

In use, as shown in FIG. 5, the apparatus 11 has a normal position indicated by the set of lines generally indicated at 40. As a force is applied to the tug line, the apparatus passes through an infinite number of positions such as 41 until it reaches a position 42 which is one of maximum altitude for that subject and for that exercise. There is considerable travel for the gripped end of the tug line 15, and as the subject goes from a position of exerting no force to a position of exerting maximum force, the apparatus also has a reaction that goes from no force to a maximum force. However, while the included angle between the tug line and the support line gradually increases, it never becomes a straight line. The center of gravity is always below these lines. Therefore, assuming that the line is strong enough, there is no limit on the amount of reactive force that a particular subject can get in using this device. As the muscles are contracted by the maximum amount and a maximum amount of tug is applied, there still remain some capacity on the part of the apparatus to stretch even straighter under the influence of a greater force. It is understood that in many instances, muscles acting upon skeletal levers, produce a condition of increasing the strength level within a bodypart moving toward a position of full flexion or extension. Here then the resistance of the exerciser intially follows but eventually overloads the strength curve produced by this musculoskeletal interaction without the use of elaborate cams. Thus, this apparatus produces an ideal resistance for muscular training. It is to be noted that in exercises described below, the direction of resistance remains substantially perpendicular to the limb being moved by muscular contraction, and there is little increase in mechanical advantage of the apparatus due to an incorrect angle of pull or tugging. Since the two lines never become aligned, a true isometric or static type of resistance cannot result. With this apparatus, at the beginning of a stroke, the subject brings the apparatus from a gravitationally neuter position to one of maximum reaction. As the limit of a subject's muscle contraction is approached, the isotonic movement that has taken place merges into a momentarily induced isometric state, but yet further movement is theoretically possible and therefore at the end of the movement, the nature is in fact quasiisometric.

If one shortens the vertical chain, doing so decreases the length of pull or tug that can be imparted to the apparatus, and also alters the resistance curve produced by this device. One may alter the chain length to compensate for the size of the subject and to compensate for the different types of exercises. One would use a short chain for a shoulder girdle retraction and would use the longest chain, such as four or more feet, for a straight arm pull over.

Groups of muscles that can be exercised to advantage with the present apparatus include the following:

| | |
|---|---|
| Upper arm | Shoulder |
| bicep | deltoid (anterior, posterior, lateral) |
| tricep | |
| brachialis | |
| Anterior trunk | Leg |
| pectorals | quadriceps |
| abdominals | biceps femoris |
| Upper back | Neck & forearm |
| latisimus dorsi | Muscles: anterior & posterior |
| trapezius | |
| rhomboids | |
| infraspinatus | |
| teres major & minor | |
| Lower back & hip | |
| spinal erectors | |
| gluteus maximus | |

Figure 6:
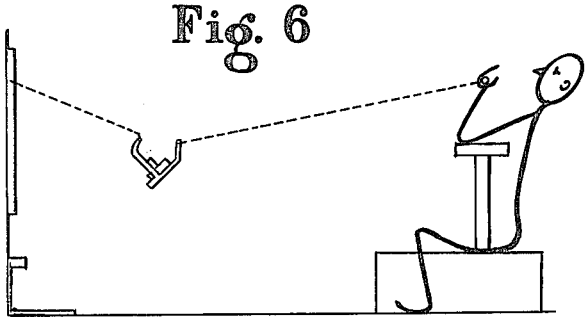

FIG. 6 indicates the ultimate position in performing the Scott bench curl, also known as the "preacher" curl. The subject begins with his arms extended forwardly in a straight manner. His upper arms are supported on the bench and then the forearms are moved up toward the face with the palms directed toward the face of the subject. This exercise is used for developing the biceps and the anterior forearm muscles. With the grip reversed, namely with the palms facing away from the body, the exercise develops the brachialis muscle.

Figure 7:
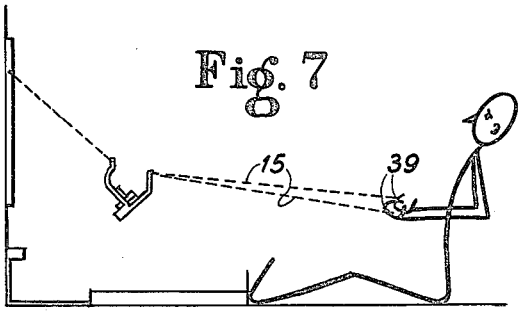

As shown in FIG. 7, the apparatus is used to provide a low seated pull, also known as a low latisimus dorsi row. The subject is seated on the floor with his feet braced so that he won't slide. The arms are extended horizontally in a forward direction with the apparatus in a gravity neutral position, and then the arms are brought back to the position diagrammed in FIG. 7. With this exercise, two tug lines 15 are used with the palms facing upwardly. The exercise of FIG. 7 also exercises the biceps and the posterior deltoid muscles.

Figure 8:
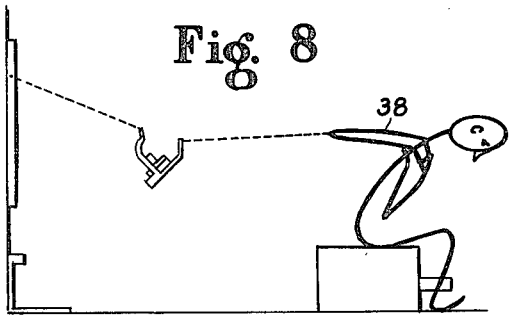

As shown in FIG. 8, the subject begins with a strap or harness over or around his shoulders which he grips and with his feet supported, with his body in a substantially horizontal position. The subject then raises the torso and continues on as far forwardly as he can. This is known as the abdominal curl. The abdominal curl exercise of FIG. 8 exercises the front or rectus abdominus muscle and is also used for abdominal rotation by holding the strap over only one shoulder for exercising the transverse abdominal muscles. The trunk is rotated against resistance with the subject in a vertical seated position.

Figure 9:
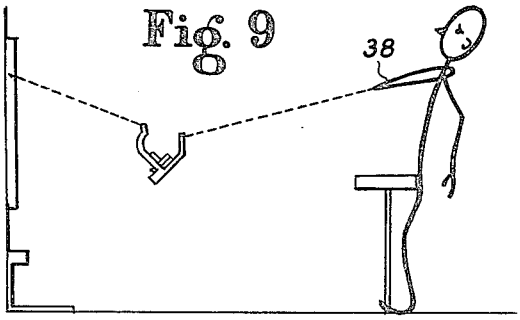

An exercise primarily for developing the spinal erectors is shown in FIG. 9. The subject stands braced against a support bench and leans over the same and from this position, which is gravity neutral for the apparatus, he brings his body to an erect or hyperextended position using the looped strap or harness 38 fitted around his neck. The exercise of FIG. 9 also is for the gluteus maximus, the posterior neck muscles, the bicep femoris or back of the thigh, and the calf of the leg.

Figure 10:
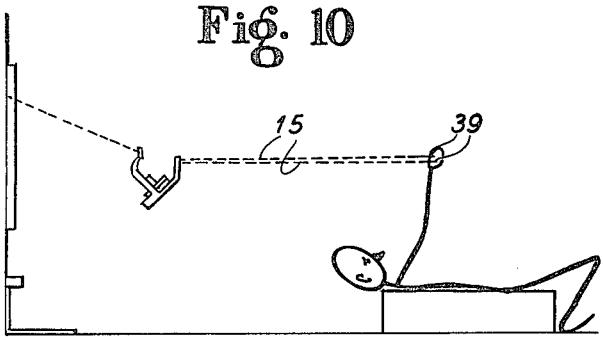

FIG. 10 illustrates the final position in the straight arm pullover. The subject begins by lying on his back with his arms stretched out horizontally above his head where he grips the separate hand grips of the apparatus with it in gravity neutral position. The arms are then pulled up and over to or beyond the position shown in FIG. 10. This exercise has both a skeletal and a muscular function. By applying a tension on the pectoral muscles, the cartilage of the rib cage is spread and thus the skeletal structure is enlarged. From a muscular standpoint, this exercise develops the latisimus dorsi or upper back muscles, it is a pectoral exercise, it exercises the triceps, the abdominal muscles and the anterior forearm.

Some further exercises which are not illustrated are the following:

The lateral rotation exercise for the shoulder rotators, namely the infraspinatus and posterior deltoids. The subject is seated on the support structure of FIG. 6 with his back against the rest and using two tug lines he begins with his upper arms extending horizontally to the left and right and his forearms extending forward perpendicular to his upper arms. From this gravity neutral position, the forearms are rotated to a vertical position.

The tricep extension exercise. This exercise has a braced form which is like that shown in FIG. 6 except that the subject kneels on the floor with his elbows resting on the armrest. The unbraced form has the subject standing but with no brace for the upper arm.

The medial rotation exercise for the pectoralis major and teres major muscles begins with the subject lying face down with his head toward the apparatus on a bench such as shown in FIG. 10. The exercise is then something like the lateral rotation described above, but beginning with the arms in the final position at the gravity neutral position and thence moving the forearms downwardly about 90 degrees.

The seated retraction exercise begins from the same position as that described for FIG. 7 but without flexing the arms. Instead, the shoulders are pulled back so that there is produced a shoulder girdle retraction for the trapezius and rhomboid muscles.

The tricep pull back exercise begins with the subject standing and facing the apparatus. Using two tug lines 15, both handles are gripped separately from a straight-out position of the arms. The arms are then moved straight down through a vertical position to a terminal point of hyper-extension of the arms. This exercise is about equally good for both the posterior deltoid and the triceps.

From the foregoing it can be seen that a wide range of exercises can be performed with this single apparatus for the development of a wide range of muscles of the human body.

Although various minor modifications may be suggested by those versed in the art, it should be understood that I wish to embody within the scope of the patent warranted hereon, all such embodiments as reasonably come within the scope of my contribution to the art.

I claim as my invention:

1. Physical exercise apparatus, comprising:

(a) a support bracket adapted to be fixedly secured in place;

(b) a flexible support line secured at one end to said support bracket and normally extending downwardly from the point of securement, and a free end at the opposite end of said support line;

(c) weight means secured to said free end of said support line, and supported thereby for upward swinging movement; and (d) at least one flexible tug line secured at one end to said weight means at a point spaced from said free end of said support line for extending laterally therefrom, and having means at its other end by which a lateral tugging force may be applied thereto, whereby said weight means as it swings upwardly provides progressively greater resistance to said lateral tugging force.

2. Physical exercise apparatus according to claim 1 including a stop adapted to be fixedly secured in place, and disposed to be engaged by said weight means when no tugging force is applied to said tug line.

3. Physical exercise apparatus according to claim 1 including a restraining line connected at one end to said weight means, and having a portion wound onto a governor-controlled reel, whereby an isokinetic type of resistance can be added to said weight means in response to tugging on said tug line.

4. Physical exercise apparatus according to claim 1, said support bracket having means acting between it and said support line for varying the effective length of said support line and the effective height of its said one end.

5. Physical exercise apparatus according to claim 4, said varying means including a pair of spaced vertical flanges, each having a vertical row of apertures aligned with the other and between which said support line extends, and a pin receivable in a pair of aligned apertures for trapping an upper end portion of said support line.

6. Physical exercise apparatus according to claim 2, said stop having an elastomer-lined recess receptive of said weight means.

7. Physical exercise apparatus according to claim 1, said tugging means comprising a centrally connected bar adapted to be gripped by two hands.

8. Physical exercise apparatus according to claim 1, said tugging means comprising a looped strap through which the head may extend.

9. Physical exercise apparatus according to claim 1 including two of said tug lines, said tugging means comprising separate hand grips connected to said other ends of said tug lines respectively.

10. Physical exercise apparatus according to claim 1 said weight means comprising a cage having means for supporting a selected number of weights therein.

11. Physical exercise apparatus according to claim 10 said weight supporting means comprising a generally upstanding post receptive of apertured bar-bell weights.

12. Physical exercise apparatus according to claim 10, said cage having an upper tab and a lower tab projecting beyond its center to which said support and tug lines are respectively connected, whereby the center of gravity of said weight means will always be below said lines.

13. Physical exercise apparatus according to claim 12, said tabs being directed upwardly with respect to the bottom of said cage.

* * * * *